US009976783B2

(12) United States Patent
Shimazu

(10) Patent No.: US 9,976,783 B2
(45) Date of Patent: May 22, 2018

(54) REFRIGERATION CYCLE APPARATUS

(71) Applicant: Mitsubishi Electric Corporation, Tokyo (JP)

(72) Inventor: Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 112 days.

(21) Appl. No.: 14/915,278

(22) PCT Filed: Sep. 24, 2013

(86) PCT No.: PCT/JP2013/075776
§ 371 (c)(1),
(2) Date: Feb. 29, 2016

(87) PCT Pub. No.: WO2015/045011
PCT Pub. Date: Apr. 2, 2015

(65) Prior Publication Data

US 2016/0209088 A1 Jul. 21, 2016

(51) Int. Cl.
*F25B 31/00* (2006.01)
*F25B 41/04* (2006.01)
(Continued)

(52) U.S. Cl.
CPC ..... *F25B 31/004* (2013.01); *F25B 41/04* (2013.01); *F25B 41/062* (2013.01);
(Continued)

(58) Field of Classification Search
CPC ..... F25B 31/004; F25B 49/02; F25B 43/02
See application file for complete search history.

(56) References Cited

U.S. PATENT DOCUMENTS 4,735,058 A * 4/1988 Umezu ..... F24F 11/085 62/196.3
5,369,958 A * 12/1994 Kasai ..... F24F 3/065 62/158
(Continued)

FOREIGN PATENT DOCUMENTS

CN 1185572 A 6/1998
CN 101846417 A 9/2010
(Continued)

OTHER PUBLICATIONS

Office Action dated Jul. 19, 2016 issued in corresponding JP patent application No. 2015-538664 (and English translation).
(Continued)

*Primary Examiner* — Len Tran
*Assistant Examiner* — Kamran Tavakoldavani
(74) *Attorney, Agent, or Firm* — Posz Law Group, PLC

(57) ABSTRACT

A refrigeration cycle apparatus includes connected in series a compressor, an oil separator, a condenser, an expansion valve, and an evaporator, and comprising: a distributor communicating to the oil separator and configured to branch a flow of refrigerating machine oil separated within the oil separator; a first oil return flow path to cause the flow of the refrigerating machine oil branched by the distributor to flow into a suction side of the compressor, the first oil return flow path including an expansion valve; and a second oil return flow path to cause the flow of the refrigerating machine oil branched by the distributor to flow into the suction side of the compressor, the second oil return flow path including an oil tank accumulating refrigerating machine oil and a valve provided between the oil tank and the suction side of the compressor, the distributor having a distributor main body in which an inflow opening port communicating to the oil separator, a first oil return opening port communicating to the first oil return flow path, and a second oil return opening
(Continued)

port communicating to the second oil return flow path are formed, the first oil return opening port provided at an upper portion of the distributor main body, the second oil return opening port being provided at a lower portion of the distributor main body.

8 Claims, 3 Drawing Sheets

(51) Int. Cl.
*F25B 49/02* (2006.01)
*F25B 41/06* (2006.01)
*F25B 43/00* (2006.01)
*F25B 43/02* (2006.01)

(52) U.S. Cl.
CPC ..... *F25B 43/006* (2013.01); *F25B 43/02* (2013.01); *F25B 49/02* (2013.01); *F25B 49/022* (2013.01); *F25B 2400/04* (2013.01); *F25B 2500/19* (2013.01); *F25B 2500/26* (2013.01); *F25B 2600/025* (2013.01); *F25B 2600/23* (2013.01); *F25B 2600/2515* (2013.01); *F25B 2700/171* (2013.01); *F25B 2700/1931* (2013.01); *F25B 2700/2117* (2013.01); *F25B 2700/21151* (2013.01); *F25B 2700/21152* (2013.01); *F25B 2700/21161* (2013.01); *F25B 2700/21162* (2013.01)

(56) References Cited

U.S. PATENT DOCUMENTS

| | | | | |
|---|---|---|---|---|
| 5,970,722 | A | 10/1999 | Shibata et al. | |
| 2003/0066302 | A1* | 4/2003 | Ueno | F04B 39/0207 62/192 |
| 2009/0133435 | A1* | 5/2009 | Toyoshima | F25B 31/004 62/473 |
| 2009/0183517 | A1* | 7/2009 | Ino | F25B 31/008 62/87 |
| 2010/0175400 | A1* | 7/2010 | Kasahara | F25B 1/10 62/225 |
| 2010/0199712 | A1* | 8/2010 | Lifson | F25B 41/04 62/498 |
| 2011/0041524 | A1* | 2/2011 | Lifson | F25B 6/04 62/79 |
| 2013/0145785 | A1* | 6/2013 | Nobuhiro | F25B 49/02 62/160 |
| 2014/0331712 | A1 | 11/2014 | Kan et al. | |

FOREIGN PATENT DOCUMENTS

| | | | |
|---|---|---|---|
| JP | S62-130370 | U | 8/1987 |
| JP | 05-264110 | A | 10/1993 |
| JP | 10-185337 | A | 7/1998 |
| JP | 2005-345032 | A | 12/2005 |
| JP | 2007-093182 | A | 4/2007 |
| JP | 2010-175189 | A | 8/2010 |
| JP | 2010-175190 | A | 8/2010 |
| JP | 2011-089736 | A | 5/2011 |
| JP | 2011-133209 | A | 7/2011 |
| JP | 2011-196594 | A | 10/2011 |
| WO | 2013099047 | A1 | 7/2013 |

OTHER PUBLICATIONS

Office Action dated Jul. 6, 2017 for the corresponding CN patent application No. 201380079772.2 (English translation).
Office Action dated Feb. 21, 2017 issued in the corresponding JP application No. 2015-538664 (English translation attached).
Chinese Office Action dated Dec. 21, 2016 in the corresponding CN application No. 201380079772.2(English translation attached).
The Extended European Search Report dated Apr. 7, 2017 in the corresponding EP application No. 13894516.7.
International Search Report of the International Searching Authority dated Dec. 17, 2013 for the corresponding international application No. PCT/JP2013/075776 (and English translation).

* cited by examiner

REFRIGERATION CYCLE APPARATUS

CROSS REFERENCE TO RELATED APPLICATION

This application is a U.S. national stage application of International Application No. PCT/JP2013/075776 filed on Sep. 24, 2013, the disclosure of which is incorporated herein by reference.

TECHNICAL FIELD

The present invention relates to a refrigeration cycle apparatus configured to return refrigerating machine oil separated by an oil separator to a compressor.

BACKGROUND ART

Traditionally, in a refrigeration cycle apparatus in which a compressor, an oil separation unit, a condenser, an expansion valve, and an evaporator are connected in the named order, an oil separator is provided at the discharge side of the compressor for discharging refrigerating machine oil along with refrigerant from the compressor. Also, the refrigerating machine oil having been separated from the refrigerant in the oil separator is returned again to the suction side of the compressor. Here, various flow paths and control methods for returning the oil from the oil separator to the compressor are proposed (see, for example, the patent literatures 1 to 3).

Patent Literature 1 discloses a refrigeration cycle apparatus in which a connection pipe including a capillary tube and a flow path, which has an oil tank, a valve, and a capillary tube, are connected in parallel with each other between an oil separator and a suction side of a compressor. Also, opening and closing of the valve is controlled based on a discharge temperature of refrigerant discharged from the compressor and a temperature of a refrigerating machine oil flowing in the connection pipe (or the temperature of the refrigerant taken into the compressor). Patent Literature 2 discloses an air conditioner in which an oil tank is connected via a capillary to an oil separator, and a first circuit having a solenoid valve and a second circuit are connected in parallel with each other between the oil tank and a suction side of a compressor. Also, in activation after non-operation, the solenoid valve is opened and a refrigerating machine oil stored in the oil tank is supplied to the compressor. Patent Literature 3 discloses an air conditioning apparatus in which a first flow path including an expansion device and a second flow path including an expansion device and a solenoid valve are connected in parallel with each other between an oil separator and a suction side of a compressor. Also, opening and closing of the solenoid valve is controlled based on the degree of superheat of the suction side of the compressor or an operation frequency.

CITATION LIST

Patent Literature

Patent Literature 1: Japanese Unexamined Patent Application Publication No. 2011-196594

Patent Literature 2: Japanese Unexamined Patent Application Publication No. H5-264110

Patent Literature 3: Japanese Unexamined Patent Application Publication No. 2005-345032

SUMMARY OF INVENTION

Technical Problem

Here, the oil separator does not completely separate the refrigerant and the refrigerating machine oil from each other and the refrigerant and the refrigerating machine oil flow out of the oil separator in a state where they are mixed with each other. Accordingly, as in Patent Literatures 1 and 2, even when the oil tank communicates to the oil separator, it is not possible to store the refrigerating machine oil alone in the oil tank, and surplus refrigerating machine oil circulates in the refrigeration cycle. As a result, surplus refrigerating machine oil is supplied in the compressor, and the compressor inputs may be increased. In addition, in Patent Literatures 1 to 3, when the surplus refrigerating machine oil is discharged from the compressor, the separation capability at the oil separator is surpassed and the oil separation efficiency is decreased. Then, a state is entered where a large amount of refrigerating machine oil remains to reside within the refrigeration cycle, which may cause depletion of the refrigerating machine oil within the compressor.

An object of the present invention, which has been made to provide a solution to the above problems, is to provide a refrigeration cycle apparatus capable of reliably supplying refrigerator in a compressor and ensuring reliability while achieving reduction in the compressor inputs.

Solution to Problem

A refrigeration cycle apparatus including, connected in series, a compressor, an oil separator, a condenser, an expansion valve, and an evaporator, the refrigeration cycle apparatus comprising: a distributor communicating to the oil separator and configured to branch a flow of refrigerating machine oil separated within the oil separator; a first oil return flow path configured to cause the flow of the refrigerating machine oil branched by the distributor to flow into a suction side of the compressor, the first oil return flow path including an expansion valve; and a second oil return flow path configured to cause the flow of the refrigerating machine oil branched by the distributor to flow into the suction side of the compressor, the second oil return flow path including an oil tank accumulating refrigerating machine oil and a valve provided between the oil tank and the suction side of the compressor, the distributor having a distributor main body in which an inflow opening port communicating to the oil separator, a first oil return opening port communicating to the first oil return flow path, and a second oil return opening port communicating to the second oil return flow path are formed, the first oil return opening port being provided at an upper portion of the distributor main body, and the second oil return opening port being provided at a lower portion of the distributor main body.

Advantageous Effects of Invention

According to the refrigeration cycle apparatus of the present invention, since the first oil return opening port is provided at the upper portion of the distributor main body and the second oil return opening port is provided at the lower portion of the distributor main body, the refrigerator oil is accumulated preferentially to the side of the oil tank, so that it is made possible to prevent increase in the compressor inputs due to the surplus refrigerating machine oil and reduce the amount of refrigerating machine oil remaining to reside within the refrigeration cycle and thereby suppress decrease in the oil separation efficiency due to insufficient volume of the oil separator, and thus reliably supply the refrigerating machine oil within the compressor and ensure reliability.

DESCRIPTION OF EMBODIMENTS

Figure 1:
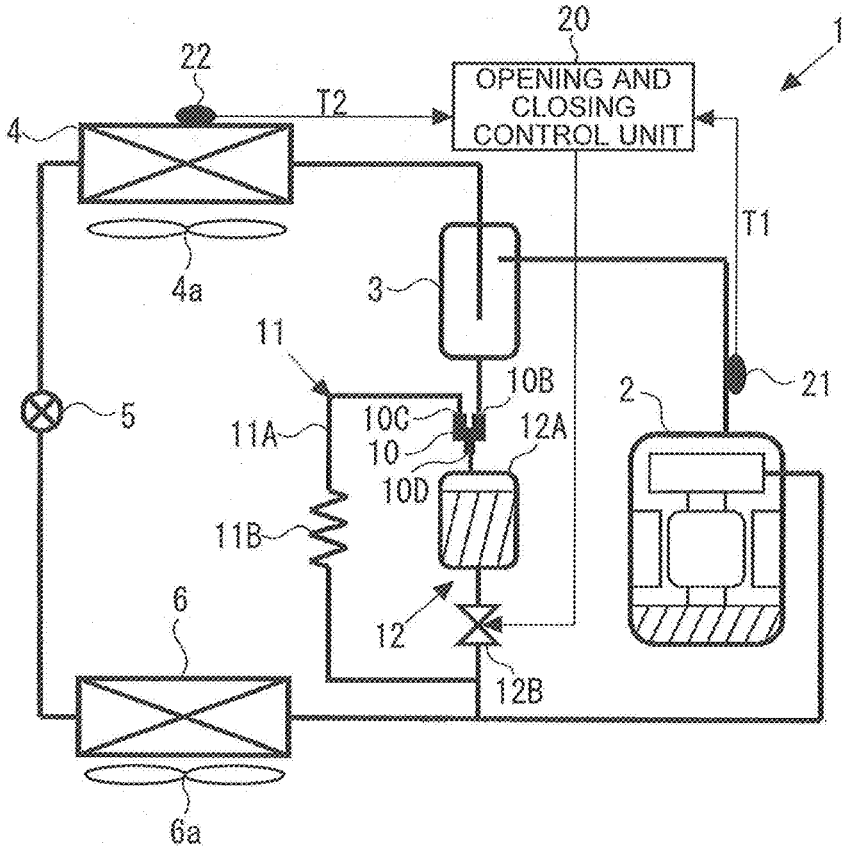
FIG. 1 is a refrigerant circuit diagram illustrating an embodiment 1 of a refrigeration cycle apparatus according to the present invention.

A preferred embodiment of a refrigeration cycle apparatus of the present invention is described below with reference to the drawings. FIG. 1 is a refrigerant circuit diagram of the refrigeration cycle apparatus. In the refrigeration cycle apparatus 1 are connected a compressor 2, an oil separator 3, a condenser 4, an expansion valve 5, and an evaporator 6 in this order. The compressor 2 is configured to compress and discharge refrigerant that has been taken in. The oil separator 3 is configured to separate refrigerant and the refrigerating machine oil, which are discharged from the compressor 2 and have high temperature and high pressure, from each other and, for example, separates the refrigerant and the refrigerating machine oil by the effect of centrifugation, gravity, or a filter. Since the refrigerating machine oil is separated by the oil separator 3, it is made possible to prevent decrease in the heat-transfer performance due to mixing of the refrigerating machine oil and decrease in the cycle performance due to increase in pressure loss.

The condenser 4 is configured to exchange heat between the refrigerant compressed in the compressor 2 and, for example, outdoor air (outside air) and condense and liquefy the refrigerant. Also, the condenser is provided with a condenser fan 4*a* that causes outside air to flow into the condenser 4 so that blowing of air takes place from the condenser fan 4*a* to the condenser 4. The expansion valve 5 is configured to adjust the amount of flow, etc. of the passing refrigerant by changing the opening degree thereof, adjust the pressure of the refrigerant, and thus allows the refrigerant to flow to the side of the evaporator 6. The evaporator 6 is configured to exchange heat between air and the refrigerant expanded to have a low-pressure state by the expansion valve 5. In the meantime, the evaporator 6 is provided with an evaporator fan 6*a* so that blowing of air takes place from the evaporator fan 6*a*.

Next, the example operation of the refrigeration cycle apparatus 1 is described with reference to FIG. 1. First, the gaseous refrigerant with a high temperature and a high pressure that is compressed by the compressor 2 flows into the condenser 4 after the refrigerant and the refrigerating machine oil are separated from each other in the oil separator 3. The refrigerant flowing in the condenser 4 is subjected to heat dissipation through heat exchange with the outside air and then condensed. The condensed high-pressure liquid refrigerant is pressure-decreased by the expansion valve 5 and becomes low-pressure two-phase refrigerant. This low-pressure two-phase refrigerant takes in the heat from a load such as air, etc. that is the target of cooling in the evaporator 6, becomes a low-pressure gaseous refrigerant, and thus flows to the suction side of the compressor 2. Also, the refrigerant is again taken in by the compressor 2.

Here, when the refrigerant passes through the condenser 4, the expansion valve 5, and the evaporator 6 and thus circulates to the compressor 2, the refrigerating machine oil also circulates within the refrigeration cycle. As the moving speed of the refrigerating machine oil at this point is lower than the moving speed of the refrigerant, the refrigerating machine oil seemingly stagnates within the refrigeration cycle. The amount of the stagnating refrigerating machine oil increases as a pipe of one refrigeration cycle becomes long, and the amount of oil inside of the compressor 2 decreases as the amount of the stagnating refrigerating machine oil increases. To prevent decrease in the amount of oil inside of the compressor 2 even in such a state, the amount of refrigerating machine oil to be sealed in the refrigeration cycle apparatus 1 has to be increased. Meanwhile, as illustrated in FIG. 1, the refrigerating machine oil in the refrigerant is separated at the oil separator 3 provided at the discharge side of the compressor 2 and thus it is made possible to keep low the circulation ratio of the refrigerating machine oil to the refrigerant. Hence, the length of the refrigeration cycle does not affect the decrease of amount of oil inside of the compressor 2 or increase in the refrigerating machine oil sealed within the refrigeration cycle apparatus 1.

However, when the oil separation efficiency by the oil separator 3 is decreased and the separation capability for separating the refrigerating machine oil is surpassed, the refrigerating machine oil that could not be separated in the oil separator 3 circulates from the oil separator 3 to the side of the expansion valve 5, which leads to a situation where decrease in the amount of oil occurs inside of the compressor 2. In particular, for example, when the compressor 2 is activated in a state where the liquid refrigerant exists inside of the compressor 2 with the low-temperature outside air, or when it is reactivated after defrosting in a state where the liquid refrigerant and the refrigerating machine oil exist inside of the compressor 2 at the time of heating operation, then the liquid refrigerant rapidly bubbles (being vaporized) or the degree of refrigerant solubility of the refrigerating machine oil is rapidly decreased. Then the refrigerating machine oil within the shell of the compressor 2 is discharged in a large amount from the compressor 2 along with the refrigerant, and it circulates, without the refrigerating machine oil being separated in the oil separator 3, through the condenser 4, the expansion valve 5, and the evaporator 6. The amount of oil within the compressor 2 is decreased before the time when this large-amount refrigerating machine oil that has been discharged returns, which may cause decrease in the reliability such as poor lubrication.

In view of this, the refrigeration cycle apparatus 1 of FIG. 1 is configured such that it can reliably supply refrigerating machine oil to the compressor 2 even in a situation where the compressor 2 may be depleted of the refrigerating machine oil such as at the time of activation of the compressor 2 and thus prevent decrease in the reliability due to decrease in the amount of oil within the compressor 2. Specifically, the refrigeration cycle apparatus 1 has a distributor 10, a first oil return flow path 11, and a second oil return flow path 12.

Figure 2:
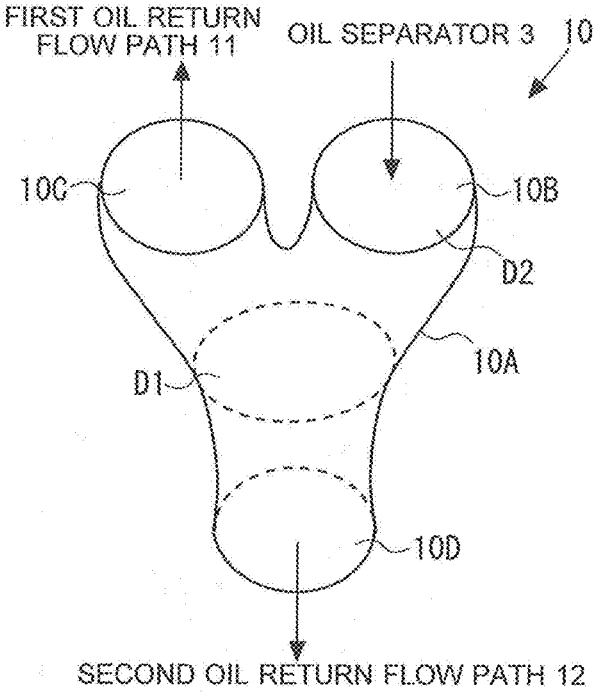
FIG. 2 is a schematic diagram illustrating an example of a distributor of the refrigeration cycle apparatus of FIG. 1.

FIG. 2 is a schematic diagram illustrating an example of the distributor in the refrigeration cycle apparatus of FIG. 1. The distributor 10 of FIGS. 1 and 2 is configured to cause the refrigerating machine oil that has been separated in the oil separator 3 to branch into the first oil return flow path 11 and the second oil return flow path 12, and the distributor 10 has a distributor main body 10A in which an inflow opening port 10B, a first oil return opening port 100, and a second oil return opening port 10D are formed. The inflow opening port 10B communicates to the oil separator 3, the first oil return opening port 100 communicates to the first oil return flow path 11, and the second oil return opening port 10D communicates to the second oil return flow path 12.

The inflow opening port 10B and the first oil return opening port 100 are provided at the upper portion of the distributor main body 10A, and the second oil return opening port 10D is provided at a lower portion of the distributor main body 10A. The distributor 10 separates the refrigerating machine oil and the refrigerant flowing from the oil separator 3 from each other, and the distributor 10 has a structure in which the separated refrigerating machine oil is allowed to flow preferentially to the side of the second oil return opening port 10D by the gravity. Specifically, since the oil separator 3 does not completely separate the refrigerant and the refrigerating machine oil from each other, the refrigerating machine oil flows from the oil separator 3 to the distributor 10 in a state it is mixed with the refrigerant. The density of the refrigerating machine oil having flowed into the distributor 10 is larger than the density of the high-temperature refrigerant (in a gaseous state). As a result, the refrigerating machine oil tends to flow more readily to the lower side of the distributor main body 10A by the gravity than the refrigerant. Accordingly, the refrigerating machine oil flowing into the distributor 10 flows preferentially to the side of the second oil return opening port 10D when the refrigerant has been separated within the distributor main body 10A. In the meantime, also in the distributor 10, the refrigerating machine oil and the refrigerant are not completely separated from each other, either, and the refrigerating machine oil mixed with the refrigerant also branches from the first oil return opening port 10C and is returned to suction side of the compressor 2.

In particular, the flow path area D1 within the distributor main body 10A is formed such that the area D1 is larger than the flow path area D2 of the inflow opening port 10B, the first oil return opening port 100, and the second oil return opening port 10D (D1>D2). Accordingly, the flow rate of the refrigerating machine oil flowing in from the inflow opening port 10B is decreased within the distributor main body 10A, and the magnitude of impact of the gravity upon the refrigerating machine oil in which the refrigerant is mixed becomes larger than that of the flow rate. As a result, it is made possible to further accelerate separation between the refrigerant and the refrigerating machine oil within the distributor main body 10A.

The first oil return flow path 11 communicates to the first oil return opening port 100 of the distributor 10 and the suction side of the compressor 2, and forms a flow path for returning the refrigerating machine oil that has branched at the distributor 10 to the compressor 2. The first oil return flow path 11 has a branch pipe 11A and an expansion valve 11B arranged on the branch pipe 11A. The expansion valve 11B is configured to reduce the pressure of the refrigerating machine oil flowing through the branch pipe 11A, and may be constituted by, for example, a capillary tube or an electronic control valve.

The second oil return flow path 12 communicates to the first oil return opening port 100 of the distributor 10 and the suction side of the compressor 2, and forms a flow path extending in parallel with the first oil return flow path 11. The second oil return flow path 12 has an oil tank 12A and a valve 12B. The oil tank 12A communicates to a second oil return opening port 10D of the distributor 10 and is configured to store the refrigerating machine oil flowing from the second oil return opening port 10D of the distributor 10. The valve 12B communicates to the lower side of the oil tank 12A.

The valve 12B, which may be constituted, for example, by a solenoid valve, communicates to the lower side of the oil tank 12A and connected to the suction side of the compressor 2. In the meantime, the operation of the valve 12B is controlled by the opening and closing control unit 20. Also, when the valve 12B is closed, the refrigerating machine oil flowing into the second oil return flow path 12 accumulates in the oil tank 12A, and the refrigerating machine oil does not flow from the second oil return flow path 12 into the compressor 2. In the meantime, when the oil tank 12A is filled with the refrigerating machine oil, the refrigerating machine oil supplied from the oil separator 3 will flow via the distributor 10 from the first oil return flow path 11 to the side of the compressor 2. On the other hand, when the valve 12B is opened, the refrigerating machine oil within the oil tank 12A is supplied to the compressor 2 by virtue of the difference in pressure between the discharge side and the suction side of the compressor 2.

Figure 3:
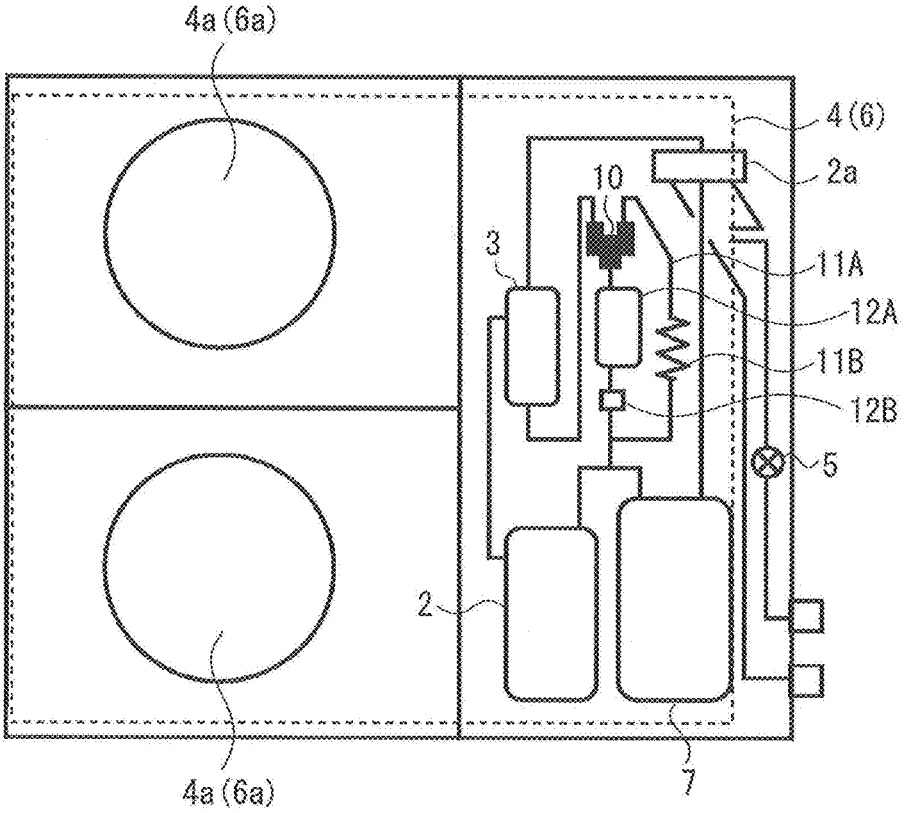
FIG. 3 is a schematic diagram illustrating an example of an outdoor unit of the refrigeration cycle apparatus of FIG. 1.

FIG. 3 is a schematic diagram illustrating an example of the outdoor unit in the refrigeration cycle apparatus 1 of FIG. 1. The above-described compressor 2, the oil separator 3, and a heat exchanger serving as the condenser 4 or the evaporator 6, etc. are accommodated in the outdoor unit of FIG. 3, and refrigerant components including the valve 12B, the expansion valve 5, the expansion valve 11B, etc. are accommodated therein. In the meantime, pipes and the like forming the refrigeration cycle are collectively provided inside of the outdoor unit. Space saving can be achieved by installing the above-described oil tank 12A and the oil separator 3 above the compressor 2.

Next, the flow of the refrigerating machine oil is described with reference to FIGS. 1 to 3. The refrigerating machine oil discharged along with the refrigerant from the compressor 2 is separated from the refrigerant at the oil separator 3, and flows into the inflow opening port 10B of the distributor 10 in a state where it is mixed with the refrigerant. The refrigerating machine oil having flowed into the distributor 10 branches from the first oil return opening port 100 into the first oil return flow path 11, and braches from the second oil return opening port 10D into the second oil return flow path 12. At this point, the refrigerant and the refrigerating machine oil are also separated from each other within the distributor 10 and the refrigerating machine oil is made to flow preferentially to the lower-side second oil return opening port 10D (to the side of the second oil return flow path 12) under the effect of gravity. In particular, as the flow path area D1 within the distributor main body 10A is larger than the flow path area D2 of each of the openings 10B to 10D, the refrigerating machine oil within the distributor main body 10A is more susceptible to gravity than to the fluid power, so that the refrigerating machine oil having higher density than the gaseous refrigerant is made to flow to the side of the lower-side second oil return opening port 10D (to the side of the second oil return flow path 12) preferentially relative to the first oil return opening port 10C.

The refrigerating machine oil that flowed from the inflow opening port 10B into the first oil return flow path 11 flows via the expansion valve 11B into the suction side of the compressor 2. On the other hand, the refrigerating machine oil that flowed from the second oil return opening port 10D into the second oil return flow path 12 flows into the oil tank 12A. Here, when the valve 12B is closed, the refrigerating machine oil accumulates within the oil tank 12A. In the meantime, the refrigerating machine oil passes the first oil return flow path 11 and is thus supplied to the compressor 2 during the process in which the refrigerating machine oil accumulates in the oil tank 12A. Also, when the oil tank 12A is filled with the refrigerating machine oil, the refrigerating machine oil does not flow from the distributor 10 to the second oil return flow path 12 but flows from the side of the first oil return flow path 11 to the compressor 2. On the other hand, when the valve 12B is opened, the refrigerating machine oil accumulated in the oil tank 12A is supplied to the suction side of the compressor 2. At this point, the refrigerating machine oil is also supplied from the first oil return flow path 11 to the suction side of the compressor 2.

In this manner, when the refrigerant and the refrigerating machine oil mixed with each other flow into the distributor 10, the distributor 10 distributes the refrigerating machine oil such that the refrigerating machine oil flows to the side of the second oil return flow path 12 preferentially with respect to the first oil return flow path 11, so that it is made possible to reliably store the refrigerating machine oil with a short period of time within the oil tank 12A of the second oil return flow path 12. Accordingly, surplus refrigerating machine oil does not exist within the compressor 2 and there occurs no agitation loss due to the rotation system such as a rotor and a shaft within the compressor 2, so that it is made possible to reduce the compressor inputs. In addition, since there is not increase in the oil discharged from the compressor 2 due to increase in agitation of the refrigerating machine oil, decrease in heat transfer and decrease in the cycle performance due to increase in pressure loss can be reduced. Further, even when the valve 12B is in a closed state, the refrigerating machine oil is not stored exceeding the volume of the oil tank 12A, so that it is made possible to prevent depletion of the refrigerating machine oil in the compressor 2 and suppress the bypass loss.

In particular, when R32 refrigerant (hydrofluorocarbon) is used as the refrigerant, the refrigerant has a characteristic that the refrigerating machine oil is less soluble in the refrigerant than in R410A refrigerant or the like, so that the viscosity of the refrigerating machine oil in the refrigerant atmosphere tends to increase. With increased viscosity of the refrigerating machine oil, the amount of oil staying within the refrigeration cycle is also increased, so that the effect of the surplus oil remaining in the oil tank 12A becomes significant.

In addition, since the expansion valve 11B is provided at the downstream side of the distributor 10, the size of the oil tank 12A can be made smaller than in the conventional cases where flow occurs from the oil separator 3 to the oil tank via a capillary tube. Specifically, when the refrigerating machine oil flows into the oil tank 12A after reduction of the pressure of the refrigerating machine oil of the oil separator 3 in the capillary tube, the velocity of the refrigerating machine oil after pressure reduction becomes larger than the velocity of the refrigerating machine oil prior to the pressure reduction, so that the effect due to fluid flow becomes larger than the effect of gravity. As a result, to preferentially accumulate the refrigerating machine oil out of the refrigerating machine oil containing the refrigerant flowing in the oil tank 12A, it is necessary to increase the size of the oil tank 12A, which suppresses the space of the outdoor unit. Meanwhile, since, in the refrigeration cycle apparatus 1 of FIG. 1, the expansion valve 11B is provided at the downstream side of the distributor 10, the size of the distributor 10 can be sufficiently made small compared with a case where separation by the distributor 10 takes place after pressure reduction.

In addition, when the valve 12B is opened, the refrigerating machine oil is taken into the compressor 2 via both of the first oil return flow path 11 and the second oil return flow path 12, so that the amount of refrigerating machine oil returned to the compressor 2 can be increased. Accordingly, since there remains no refrigerating machine oil that has been separated by the oil separator 3 but could not be returned and would suppress the volume of the oil separator, it is made possible to prevent decrease in the oil separation efficiency, which makes it possible to improve the cycle performance.

In the meantime, as discussed in the foregoing, it is desirable that the valve 12B in the second oil return flow path 12 is opened to ensure a required amount of oil within the compressor 2 in a situation where the compressor 2 is depleted of the oil therein and is closed to reduce the compressor inputs in a situation where the amount of oil within the compressor 2 is as large as the required amount of oil. In view of this, the refrigeration cycle apparatus 1 has an opening and closing control unit 20 configured to automatically determine the state where the compressor 2 becomes depleted of the refrigerating machine oil therein and the state where the amount of the refrigerating machine oil is as large as the required amount of oil and thus control opening and closing of the valve 12B.

First, the opening and closing control unit 20 controls the valve 12B such that the valve 12B is opened at the time of activation of the compressor 2. In the meantime, the expression "at the time of activation" of the compressor 2 as used herein also includes reactivation of the compressor 2. By virtue of this, it is made possible to avoid depletion of the refrigerating machine oil within the compressor 2. Specifically, at the time of the activation of the compressor 2, the refrigerating machine oil within the compressor 2 is readily discharged, compared with discharge at the time of being stopped, due to instantaneous generation of the rotation speed, change in the pressure, and the amount of heat generated. As a result, the separation capability of the separator 3 is surpassed, resulting in a state where the refrigerating machine oil remains to reside in the refrigeration cycle, which in turn results in depletion of the refrigerating machine oil within the compressor 2. At this point, as the difference between the discharge pressure and suction pressure of the compressor 2 increases, the refrigerating machine oil within the oil tank 12A is supplied to the compressor 2, so that it is made possible to suppress decrease of the amount of oil within the compressor 2. In addition, since the refrigerating machine oil flows out not only from the first oil return flow path 11 but also from the second oil return flow path 12, it is made possible to suppress degradation of the separation efficiency due to the refrigerating machine oil separated by the oil separator 3 not being returned but remaining within the oil separator 3.

Further, the opening and closing control unit 20 controls the valve 12B such that the valve 12B is closed when, after activation of the compressor 2, the degree of superheat SH within the shell of the compressor 2 becomes larger than a prescribed threshold SHref. Specifically, the refrigeration cycle apparatus 1 includes a discharge temperature sensor 21 and a condensing temperature sensor 22, and the opening and closing control unit 20 controls the operation of the valve 12B by calculating the degree of superheat SH based on the temperatures that have been detected by the discharge temperature sensor 21 and the condensing temperature sensor 22.

The discharge temperature sensor 21 is provided at the discharge port of the compressor 2 and is configured to detect the temperature of the refrigerant discharged from the compressor 2 as the discharge temperature T1. The condensing temperature sensor 22 is provided, for example, at the intermediate portion of the condenser 4 and is configured to detect the temperature of the refrigerant flowing in the condenser 4 as the condensing temperature T2. The opening and closing control unit 20 computes the difference between the discharge temperature T1 and the condensing temperature T2 (discharge temperature T1−condensing temperature T2) as the degree of superheat SH within the shell of the compressor 2. Also, the opening and closing control unit 20 compares the degree of superheat SH with a prescribed threshold SHref that is specified in advance, and closes the valve 12B when the degree of superheat SH is larger than the prescribed threshold SHref. On the other hand, the opening and closing control unit 20 opens the valve 12B when the degree of superheat SH is equal to or less than the prescribed threshold SHref. In the meantime, this prescribed threshold SHref is specified in view of the degree of superheat SH of a case where the operation is performed following start of the operation until the refrigeration cycle becomes stable where the refrigerant passes the condenser 4, the expansion valve 5, and the evaporator 6 and thus reaches the compressor 2.

In this manner, by closing the valve 12B when the degree of superheat SH becomes larger than the prescribed threshold SHref, it is made possible to reduce the compressor inputs while ensuring the reliability of the compressor 2 by avoiding the depletion of the refrigerating machine oil within the compressor 2. Specifically, when the liquid refrigerant exists within the shell of the compressor 2, for example, as in the case where stagnation of the refrigerant occurs at the time of activation of the compressor 2, the degree of superheat SH within the shell of the compressor 2 reduces. At this point, the refrigerant dissolves in the refrigerating machine oil, so that the apparent volume of the refrigerant is increased. The liquid refrigerant as such exists when the degree of the state of dissolution is large, and the volume of the mixture including the liquid refrigerant and the refrigerating machine oil is increased. Further, the mixture of the liquid refrigerant and the refrigerating machine oil within the compressor 2 is placed in a state of being readily discharged from compressor 2 by being agitated by the rotation diameter (such as a shaft and a rotor) in the compressor 2.

Subsequently, with increase in the temperature of the motor of the compressor 2, the degree of superheat SH within the compressor 2 is increased. Then the degree of solubility of the refrigerant in the refrigerating machine oil is decreased, causing rapid bubbling of the refrigerant. In response to this, the refrigerating machine oil is scattered and becomes subject to being readily discharged outside of the compressor 2. When the vaporization of the liquid refrigerant in the shell of the compressor 2 is completed, the amount of refrigerating machine oil discharged from the compressor 2 is decreased and the degree of superheat SH increases. At this point, the amount of oil separated by the oil separator 3 is decreased, but the amount of the refrigerating machine oil flowing out from the oil separator 3 to the side of the condenser 4 is smaller than that. During this process, since the valve 12B is opened, the refrigerating machine oil stored in the oil tank 12A is supplied into the compressor 2, so that depletion of the refrigerating machine oil within the compressor 2 is prevented.

Subsequently, when the state of the refrigeration cycle becomes stable, the amount of refrigerating machine oil discharged from the compressor 2 is decreased. In other words, even when it is closed and the surplus oil is accumulated in the oil tank 12A, the separation efficiency of the oil separator 3 is not decreased. In view of this, when the degree of superheat SH becomes larger than the prescribed threshold SHref, the opening and closing control unit 20 determines that the state of the refrigeration cycle has become stable and closes the valve 12B. By virtue of this, it is made possible to ensure the reliability of the compressor 2 as a result of avoiding depletion of refrigerating machine oil within the compressor 2 and at the same time reduce the compressor inputs.

Figure 4:
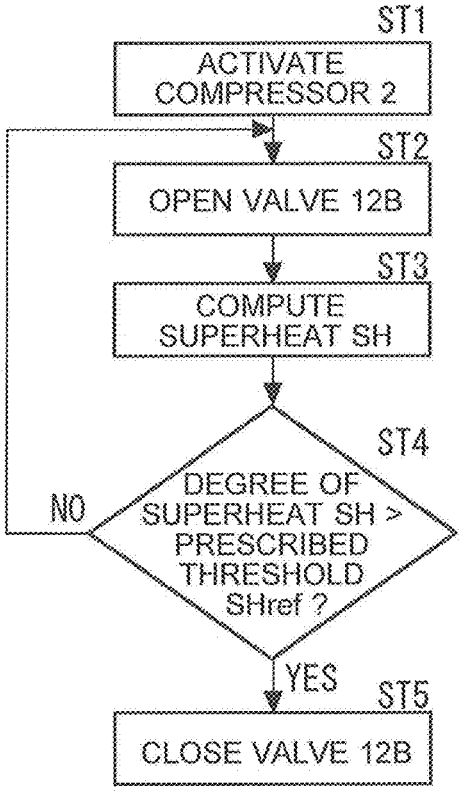
FIG. 4 is a flowchart illustrating an example of control of a valve by an opening and closing control unit of FIG. 1

FIG. 4 is a flowchart illustrating example operations of the refrigeration cycle apparatus 1 of FIG. 1 and the example operations of the refrigeration cycle apparatus 1 are described with reference to FIGS. 1 to 4. First, when the compressor 2 is activated (step ST1), the valve 12B is opened under the control of the opening and closing control unit 20 (step ST2). Also, in the opening and closing control unit 20, the degree of superheat SH (=discharge temperature T1−condensing temperature T2) of the shell within the compressor 2 is computed using the discharge temperature T1 and the condensing temperature T2 that have been detected by the discharge temperature sensor 21 and the condensing temperature sensor 22, respectively (step ST3).

Subsequently, in the opening and closing control unit 20, it is determined whether or not the degree of superheat SH is larger than the prescribed threshold SHref (step ST4). When the degree of superheat SH is equal to or less than the prescribed threshold SHref, it is determined that the state of the cycle is yet to become stable, and the valve 12B is held in its opened state until the degree of superheat SH becomes larger than the prescribed threshold SHref (step ST3, ST4). On the other hand, when the degree of superheat SH has become larger than the prescribed threshold SHref, the valve 12B is closed (step ST5). Subsequently, normal operation is performed by operations from the user or automatic control.

In this manner, by opening the valve at the time of activation when refrigerating machine oil within the compressor 2 is readily discharged, the refrigerating machine oil within the oil tank 12A can be supplied to the compressor 2 so that decrease in the amount of oil can be prevented. In addition, since not only the first oil return flow path 11 but also the second oil return flow path 12 are opened causing increase in the amount of return oil from the oil separator 3 to be increased, separation efficiency of the oil separator 3 is improved and the amount of the refrigerating machine oil discharged outside of the system is small. Since the cycle state becomes stable after operation over a certain period of time causing the amount of the discharged oil is decreased, separation efficiency of the oil separator 3 is not decreased even when it is closed and the surplus oil is accumulated in the oil tank 12A, in addition to which it is made possible to decrease the inputs of the compressor 2 and prevent the bypass loss.

In addition, since the control of opening and closing is performed not by the comparison of the difference between change in the temperature of the refrigerant under adiabatic expansion in the process of expansion and the change in the temperature of the oil as in the conventional cases, but by a large temperature difference such as liquid backflow, the operation in particular at the time of opening that requires oil supply can be performed in a short period of time.

Further, at the time of opening the valve 12B, the refrigerating machine oil within the oil tank 12A is supplied to the compressor 2 by virtue of the difference in the pressure so that the necessary oil is ensured. Since the second oil return flow path 12 is provided, the amount of oil returned from the oil separator 3 to the compressor 2 is increased, and it is made possible to prevent decrease in the efficiency of separation of the oil separator 3.

The embodiments of the present invention are not limited to the above embodiments. For example, in FIG. 3, since the drive source for driving the first oil return flow path 11 and the second oil return flow path 12 is the difference in the pressure, any positional relationships (difference in height) of the oil separator 3, the oil tank 12A, and the compressor 2 can be specified. Even when the planar space for installation is limited, the oil tank and the oil separator 3 can be installed above the compressor 2.

In addition, an example of the distributor main body 10A has been illustrated where the distributor main body 10A of the distributor 10 of FIG. 2 has a cylindrical shape. However, the distributor main body 10A does not presuppose any particular shape and may be formed in a polygonal shape including, for example, a rectangular shape as long as the first oil return opening port 10C communicates to the first oil return flow path 11 and the second oil return opening port 10D communicates to the second oil return flow path 12. Further, an example has been illustrated where the inflow opening port 10B connected to the oil separator 3 is provided at the upper portion of the distributor main body 10A. However, for example, it may be provided, for example, at the side of the distributor main body 10A. Even in such a case, it is preferable that the fluid flow area within the distributor main body 10A is formed to be larger than the fluid flow area of each of the openings 10B to 10D.

In addition, an example has been illustrated in FIG. 4 where the opening and closing control unit 20 opens the valve 12B upon activation of the compressor 2 and closes the valve 12B when the degree of superheat SH becomes larger than the prescribed threshold SHref. However, even in normal operations, the control of opening and closing of the valve 12B may be performed based on the degree of superheat SH. Specifically, at the time of activation and at the time of normal operations, the opening and closing control unit 20 may control the valve 12B such that the valve 12B is opened when the degree of superheat SH is equal to or less than the prescribed threshold SHref and the valve 12B is closed when the degree of superheat SH becomes larger than the prescribed threshold SHref.

Further, an example case has been illustrated in FIG. 4 where the opening and closing control unit 20 opens the valve 12B upon activation. However, the conditions for the opened state may be limited as long as the tendency of the amount of discharged oil of the compressor 2 upon activation is recognized. For example, when the temperature of the outside air is lower than the threshold of the prescribed outside air temperature (for example, −7 degrees C.), liquid refrigerant tends to exist within the compressor 2 that is stopped in the low outside air. In view of this, it should be ensured that the opening and closing control unit 20 opens the valve 12B when the operation frequency at the time of activation or at the time of normal operations is larger than 110 Hz, and closes the valve 12B when it becomes equal to or less than the prescribed frequency. When the operation frequency of the compressor 2 is large, the speed of the rotation system is large and the agitation energy is increased. As a result, the refrigerating machine oil within the compressor 2 may readily scatter and may be discharged outside of the compressor 2, so that the reliability is ensured and the capability is improved. Further, it may be contemplated that the opening and closing of the valve 12B may be automatically controlled at a predetermined time interval.

In addition, an example has been illustrated where the opening and closing control unit 20 of FIG. 4 detects the degree of superheat SH within the shell of the compressor 2 based on the discharge temperature T1 and the condensing temperature T2. However, the methodology of detection is not limited to this as long as the above degree of superheat SH is detected. For example, it may be contemplated that there is provided a discharge pressure sensor that directly detects the discharge pressure of the refrigerant from the compressor 2 and that the saturation temperature of the refrigerant is converted from the discharge pressure to compute the degree of superheat SH. In addition, the surface temperature of the shell may be used in place of the discharge temperature T1. Further, an example case is illustrated where the compressor 2 is the high-pressure shell. However, it may be a low-pressure shell. In that case, the opening and closing control unit 20 controls the opening and closing of the valve 12B in accordance with the difference between the evaporation temperature at the evaporator 6 and the suction temperature of the refrigerant into the compressor 2. As the evaporation temperature, two-phase temperature of the evaporator 6 may be detected, or the suction and discharge inputs may be directly detected and they may be converted into the saturation temperature of the refrigerant.

REFERENCE SIGNS LIST

1 refrigeration cycle apparatus 2 compressor 3 oil separator 4 condenser 4*a* condenser fan 5 expansion valve 6 evaporator 6*a* evaporator fan 10 distributor 10A distributor main body 10B inflow opening port 100 first oil return opening port 10D second oil return opening port 11 first oil return flow path 11A branch pipe 11B expansion valve 12 second oil return flow path 12A oil tank 12B valve 20 opening and closing control unit 21 discharge temperature sensor 22 condensing temperature sensor D1, D2 flow path area SH degree of superheat SHref prescribed threshold T1 discharge temperature T2 condensing temperature

The invention claimed is:

1. A refrigeration cycle apparatus including, connected in series, a compressor, an oil separator, a condenser, an expansion valve, and an evaporator, the refrigeration cycle apparatus comprising:

a distributor communicating to the oil separator and configured to branch a flow of refrigerating machine oil separated within the oil separator;

a first oil return flow path configured to cause the flow of the refrigerating machine oil branched by the distributor to flow into a suction side of the compressor, the first oil return flow path including an expansion valve;

a second oil return flow path configured to cause the flow of the refrigerating machine oil branched by the distributor to flow into the suction side of the compressor, the second oil return flow path including an oil tank accumulating refrigerating machine oil and a valve provided between the oil tank and the suction side of the compressor; and an opening and closing control unit configured to control opening and closing of the valve, the distributor having a distributor main body in which an inflow opening port communicating to the oil separator, a first oil return opening port communicating to the first oil return flow path, and a second oil return opening port communicating to the second oil return flow path are formed, the distributor being configured to branch the refrigerating machine oil flowing from the inflow opening port into the first oil return flow path and the second oil return flow path, the first oil return opening port being provided at an upper portion of the distributor main body, and the second oil return opening port being provided at a lower portion of the distributor main body.

2. The refrigeration cycle apparatus of claim 1, wherein the distributor main body is formed such that a flow path area of the distributor main body is larger than a flow path area of each of the inflow opening port, the first oil return opening port, and the second oil return opening port.

3. The refrigeration cycle apparatus of claim 1, wherein the opening and closing control unit is configured to control the valve such that the valve is opened upon activation of the compressor.

4. The refrigeration cycle apparatus of claim 1, wherein the opening and closing control unit is configured to control the valve such that the valve is closed where a degree of superheat within a shell of the compressor is larger than a prescribed threshold (SHref).

5. The refrigeration cycle apparatus of claim 4, further comprising:

a discharge temperature sensor detecting a temperature of refrigerant discharged from the compressor as a discharge temperature; and a condensing temperature sensor detecting a temperature of refrigerant flowing in the condenser as a condensing temperature, and wherein the opening and closing control unit is configured to compute a degree of superheat within a shell of the compressor based on the discharge temperature and the condensing temperature.

6. The refrigeration cycle apparatus of claim 1, wherein the opening and closing control unit is configured to open the valve where an operation frequency of the compressor is larger than a prescribed threshold (SHref) and close the valve where the operation frequency of the compressor is equal to or less than the prescribed threshold.

7. The refrigeration cycle apparatus of claim 1, wherein the refrigerant includes an R32 refrigerant.

8. The refrigeration cycle apparatus of claim 1, wherein the refrigerating machine oil flowing from the inflow opening port that is branched into the second oil return flow path flows to the second oil return opening port at the lower portion of the distributor main body due to gravity, and a width of an oil return flow path of the refrigerating machine oil within the distributor main body in an area which is below the first oil return opening port and the inflow opening port and which is above the second oil return opening port is wider than a width of the second oil return flow path at the second oil return opening port, and is wider than a width of the first oil return flow path at the first oil return opening port, and is wider than a width of the inflow opening port.

* * * * *